US005388331A

United States Patent [19]

Doroodian-Shoja Siamak

[11] Patent Number: 5,388,331

[45] Date of Patent: Feb. 14, 1995

[54] WEAR INDICATOR FOR A DISPOSABLE RAZOR

[76] Inventor: Doroodian-Shoja Siamak, 360 R. Hunnewell St., Needham, Mass. 02194

[21] Appl. No.: 188,244

[22] Filed: Jan. 28, 1994

[51] Int. Cl.[6] ..... B26B 21/40

[52] U.S. Cl. ..... 30/41.7; 116/208; 116/DIG. 41

[58] Field of Search ..... 30/41.7, 41; 116/208, 116/334, 335, DIG. 41

[56] References Cited

U.S. PATENT DOCUMENTS

| | | | |
|---|---|---|---|
| 2,703,451 | 3/1955 | Hensel et al. | 30/41.7 X |
| 2,750,664 | 6/1956 | Merlo | 30/41.7 |
| 2,812,575 | 11/1957 | Abbott et al. | 30/41.7 |
| 2,885,993 | 5/1959 | Murphy | 30/41.7 X |
| 3,229,659 | 1/1966 | Sciascia | 30/41.7 X |
| 3,394,456 | 7/1968 | Gatz | 30/41.7 X |
| 3,618,563 | 11/1971 | Singer | 30/41.7 X |
| 3,879,844 | 4/1975 | Grffiths | 30/41.7 |
| 4,170,821 | 10/1979 | Booth | 30/41 |
| 4,201,599 | 5/1980 | Morgans | 30/346.53 X |
| 4,208,984 | 6/1980 | Glanzman | 30/41.7 X |
| 4,268,958 | 5/1981 | Hilbert | 30/41.7 |
| 4,604,604 | 8/1986 | Mann | 340/454 |
| 4,697,342 | 10/1987 | Ferraro | 30/41 |
| 4,802,255 | 2/1989 | Breuer et al. | 116/208 X |
| 4,875,287 | 10/1989 | Creasy et al. | 30/41 X |
| 5,062,209 | 11/1991 | Rais | 30/41.7 |
| 5,119,557 | 6/1992 | Kaiko | 30/41.7 |
| 5,228,478 | 7/1993 | Kleisle | 138/104 |

FOREIGN PATENT DOCUMENTS 454943 10/1936 United Kingdom .

*Primary Examiner*—Rinaldi I. Rada
*Assistant Examiner*—Clark F. Dexter
*Attorney, Agent, or Firm*—John L. Welch

[57] ABSTRACT

A wear indicator is located on the head or frame of a disposable razor or razor cartridge, in close proximity to the shaving edge of the blade. The wear indicator comprises a mass of material that gradually wears away as the disposable razor or cartridge is used in shaving, the amount of material wearing away being correlated with the amount of wear on the blade edge to provide a visual indication of the relative wear on the blade. Preferably, the wear indicator comprises two strips of material, one atop the other, the upper strip wearing away to reveal the contrastingly-colored lower strip. Alternatively, the material may wear away to reveal indicia or lettering on the lower strip.

6 Claims, 5 Drawing Sheets

WEAR INDICATOR FOR A DISPOSABLE RAZOR

BACKGROUND OF THE INVENTION

This invention relates to disposable razors, and particularly to a visual means for readily indicating to the user the relative amount of wear that the blade of a given disposable razor has undergone.

Disposable razors have seemingly become increasingly popular because of their ease of use and the lack of required care and maintenance. Generally, disposable razors comprise a plastic handle and a frame or head, in which frame or head one or more shaving blades are mounted. Alternatively, for purposes of this application, the term "disposable razor" is also intended to include a razor blade mounted in a "cartridge," for fitting into a non-disposable handle, the cartridge itself being disposable.

The blade edge of a disposable razor gradually wears down with use, until at some point the user decides to discard the razor. For each individual shaver, the number of shaves that he or she will enjoy from a particular razor is to some extent a matter of individual choice. An individual will make a subjective judgment—based upon how the blade feels on the skin during the shaving stroke, or perhaps on other grounds—that it is time to dispose of that particular razor and begin to use a new one. Visual inspection of the blade edge itself usually yields little or no information as to how worn the blade has become.

It is believed that the typical user of a disposable razor would benefit from the inclusion of some reliable, and easily recognizable, visual indicator of the relative amount of wear that a particular disposable razor blade has undergone. With such a visual indication, it would not be necessary to determine the wear on the razor by the amount of pain or discomfort felt when the blade was used.

In this connection, it has been suggested in Hensel U.S. Pat. No. 2,703,451, to provide a so-called "tell-tale" marking on a razor blade itself, which marking will be worn away during use of the blade, thereby "telling" the user how much the blade has been used. However, since during shaving only the very edge of the blade contacts the skin area and the hair being shaved, the "tell-tale" marking of the Hensel patent is of little practical use—only the small portion of the marking at the edge of the blade will be worn away, and changes to that small portion may not be readily recognizable. Furthermore, placement of the "tell-tale" marking on the blade itself may interfere with the shaving action of the blade edge.

Griffiths U.S. Pat. No. 3,879,844 suggests the use of an "indicator mark" on the frame of a blade cartridge (or on the blade itself) to indicate whether the blade has been used or whether it is still new. However, that patent does not disclose or suggest that the "indicator mark" be used to indicate the relative amount of wear on the blade, but only whether the blade has been used at all.

Booth U.S. Pat. No. 4,170,821 discloses a "shaving aid"—such as a lubricant, whisker softener, razor cleaner, medicinal agent, and/or cosmetic agent—in the form of a water-soluble resin affixed to the frame or cartridge of a disposable razor blade adjacent the shaving edge. Upon wetting and stroking of the razor blade over the skin, the shaving aid is applied to the skin. However, nothing in Booth suggests that this "shaving aid" serve any function to indicate the relative wear on the blade.

OBJECTS OF THE INVENTION

It is an object of the present invention to provide an indicator means for a disposable razor that will present to the user a reliable visual indication of the relative wear of the razor blade.

It is a further object of the invention to provide an indicator means that is readily recognizable.

It is a still further object of the invention to provide such an indicator means that is inexpensive and simple to apply during the manufacturing process.

SUMMARY OF THE INVENTION

The subject invention, in its preferred embodiments, comprises at least one strip of contrastingly colored material applied to the frame of a disposable razor adjacent the blade, the strip of material being so chosen in composition and dimension that its abrasion characteristics are appropriately correlated to the wear characteristics of the blade, as further explained below. The strip of material is located so that it is substantially constantly in direct contact with the skin during the shaving stroke, the strip material being abraded away by friction with the skin and hair, the strip thereby giving a visual indication of the relative wear on the razor blade. In one preferred embodiment, a first strip of one color may be applied atop a second strip of another color, so that the wearing away of the first strip reveals the color of the second strip, or even a message such as "DISPOSE."

Other objects and features of the invention will be evident from the descriptions contained herein.

BRIEF DESCRIPTION OF THE DRAWINGS

The invention will be further described with reference to the accompanying drawings, in which.

DETAILED DESCRIPTION OF THE PREFERRED EMBODIMENT

Figure 1:
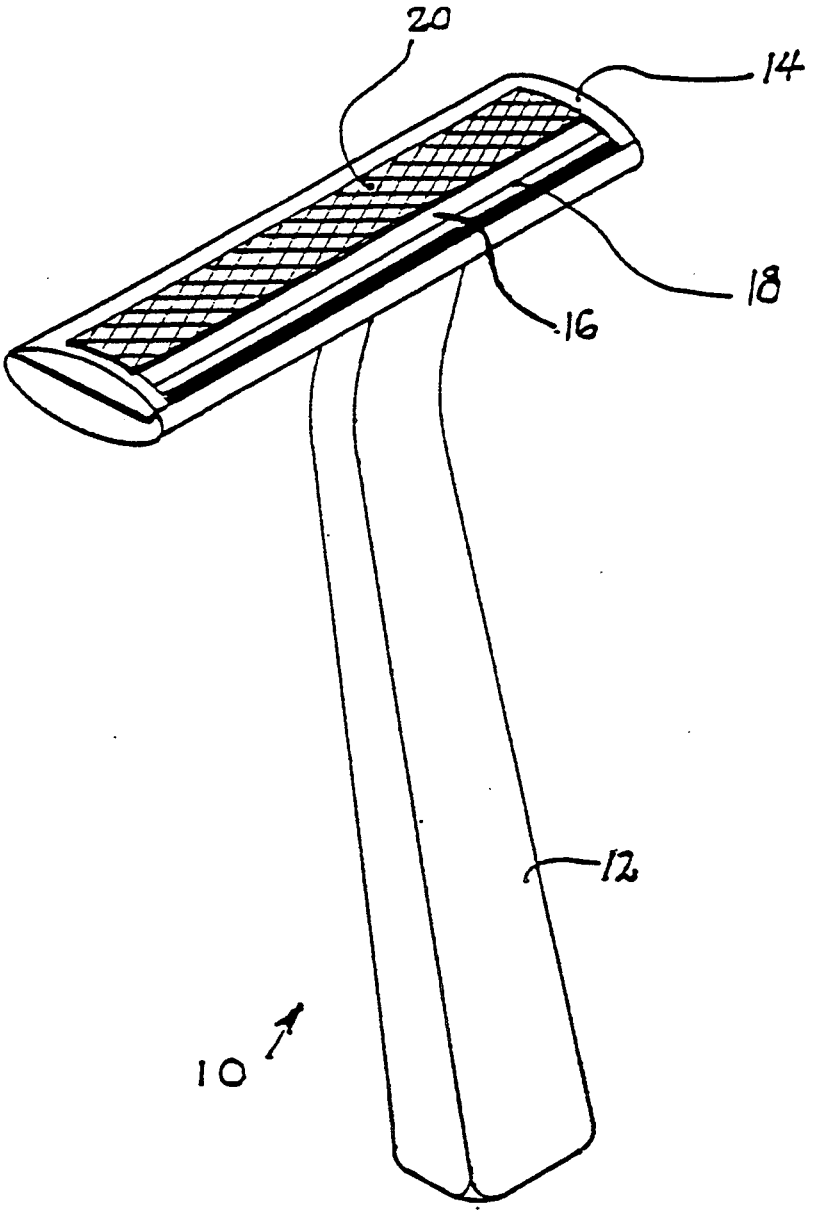
FIG. 1 is a perspective view of a disposable razor having mounted thereon, in close proximity to the blade edge, an indicator strip in accordance with the subject invention.
Figure 2:
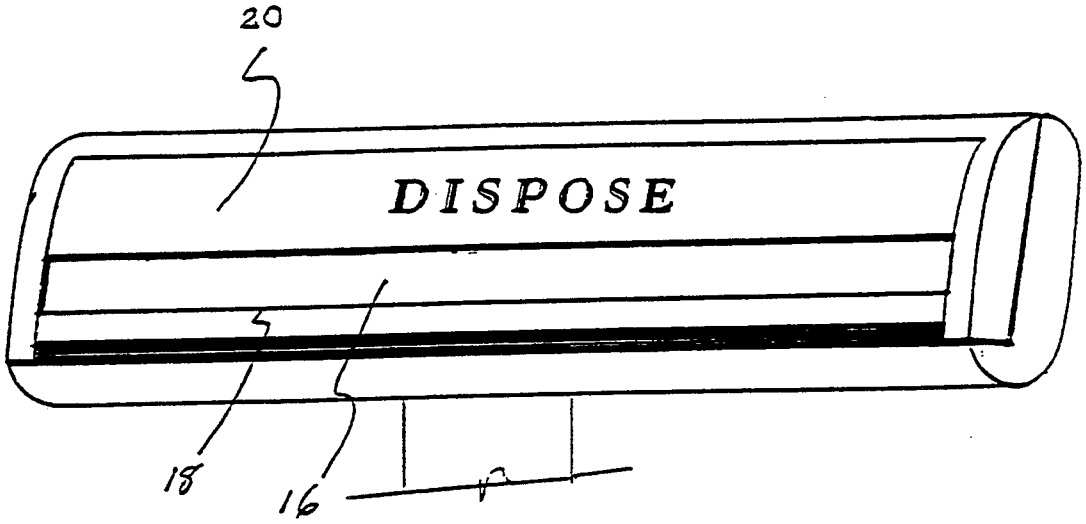
FIG. 2 is a perspective view of a disposable razor cartridge, in which the indicator strip of the invention has been worn to reveal the word "DISPOSE."

Disposable razor 10 of FIG. 1 comprises a handle 12 and frame or head 14 affixed thereto. Mounted in head 14 is a single blade 16 having a shaving edge 18. Affixed to head 14, in close proximity to the shaving edge 18, is wear indicating strip 20. Said wear indicating strip is preferably located on the other side of the blade 16 from shaving edge 18, in order that said strip 20 contacts the skin after the blade has been stroked along the skin, thus minimizing the abrasive action on the strip. The strip should be so located that it is virtually constantly in contact with the skin and hair or beard during the shaving stroke.

The wear indicating means could, of course, be of different dimension than that shown in FIG. 1—for example, not as long, or not as deep. Or it could be made of a series of small strips, or small circles, or various other geometrical configurations. In any case, during the shaving stroke, the wear indicating means will contact the skin and hair, thereby causing some of the material comprising the wear indicating means to be abraded away. By making the wear indicating means in a color that contrasts with the color of the razor head 14, the relative wear on the strip will be evident because the strip will be worn away, and the head will become visible. For example, a white strip on a blue razor head will gradually be worn away to reveal the blue color underneath.

In a preferred embodiment, two layers of material are used to comprise the wear indicating means, so that, as the uppermost layer is worn away, the color of the next layer becomes visible. As a further alternative, a word such as "DISPOSE", or other words or indicia (such as diagonal stripes or a row of stars), could be made to appear as the upper layer is worn away.

Figure 3A:
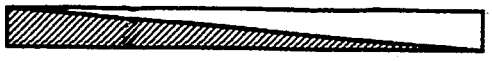
FIGS. 3*a* through 3*e* depict the progressive wearing away of the indicator means of the current invention, as seen from the front edge view of the indicator means, beginning with an unused blade (FIG. 3*a*), and then proceeding through one, two, three, and four shaves (FIGS. 3*b* through 3*e*, respectively).
Figure 3B:
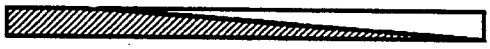
Figure 3C:
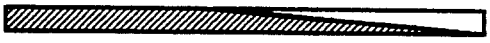
Figure 3D:
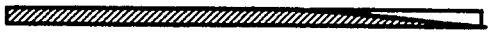
Figure 3E:
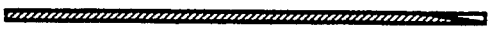
Figure 3F:
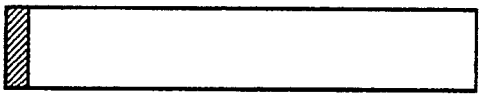
FIG. 3*f* through 3*j* depict in top plan view the same indicator means as it is progressively worn away.
Figure 3G:
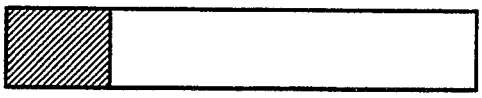
Figure 3H:
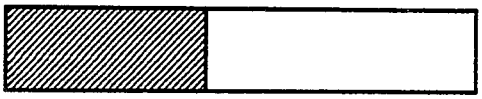
Figure 3I:
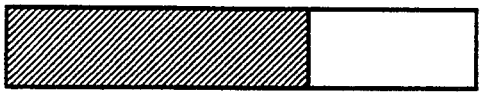
Figure 3J:
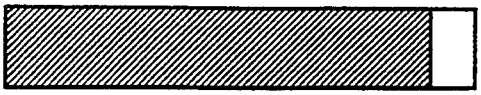
Figure 4A:
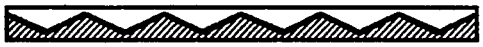
FIG. 4*a* depicts in front edge view, an alternative embodiment of the indicator means prior to shaving.
Figure 4B:
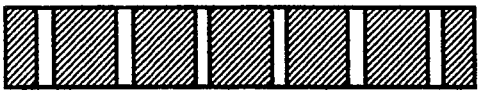
FIG. 4*b* depicts that indicator means in top plan view after several shaving episodes.
Figure 5A:
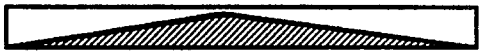
FIG. 5*a* depicts in front edge view, another alternative embodiment of the indicator means prior to shaving.
Figure 5B:
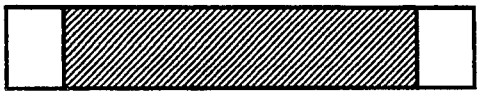
FIG. 5*b* depicts that indicator means in top plan view after several shaving episodes.
Figure 6A:
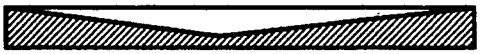
FIG. 6*a* depicts in front edge view, still another alternative embodiment of the indicator means prior to shaving.
Figure 6B:
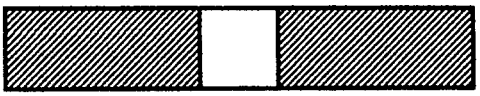
FIG. 6*b* depicts that indicator means in top plan view after several shaving episodes.

In this preferred two-layer embodiment, two basic methods for construction are contemplated. In the first method, the two layers are constructed from either the same or different material, but are of contrasting colors. The two layers may have the same longitudinal cross-sections (as, for example, in FIG. 7) or may have different longitudinal cross-sections to create different visual patterns—for example as shown in FIG. 3*a*, where the upper layer tapers from a thin edge at one end of the strip to a wide edge at the other. As the two layers wear away through abrasion and/or shear stress against the skin and hair, more and more of the contrastingly colored lower layer is disclosed (from left to right, as approximated in FIG. 3*f* through 3*j*). Other examples of the two layers having differing cross-sections are illustrated in FIGS. 4*a* and *b*, 5*a* and *b*, and 6*a* and *b*, wherein the upper layer as shown in FIGS. 4*a*, 5*a*, and 6*a*, is abraded away after a selected number of shaves to expose the lower layer (in FIGS. 4*b*, 5*b*, and 6*b*, respectively). The two layers may be adhered or molded together by known methods.

In another alternative embodiment, the indicator means may consist of a single strip of material, but colored or dyed by known methods, so as to created distinguishable zones. As the upper portion or zone of the strip (of one color) is abraded away, the contrastingly colored lower zone becomes visible.

The indicator strip may be attached to the razor head or cartridge in many different ways. For example, the strip may be adhesively secured to the head or cartridge, or may be physically mounted and held in place thereon, by known methods. See, for example, the discussion in Booth U.S. Pat. No. 4,170,821.

The layer or layers of the indicator means may be constructed from numerous chemical combinations, but the following comprise the preferred materials. First, the layer or layers may be made out of soft, low density polymers such as polyethylene oxide and/or PTFE. For further details regarding the manipulation of the chemical properties of the layer materials to achieve the desired physical properties, see *Fundamentals of Friction and Wear of Materials,* 1980 ASM Materials Seminar, Pittsburgh, Pa., Daniel A. Rigney, ed., pp. 414–416. Color dyes should be chosen so as to meet applicable FDA requirements, and may be selected from *Food and Color Additives Directory*, published by Hazelton Laboratories, Inc., Falls Church, Va. Representative suitable food dyes or colorants are FD&C Red. No. 40, Erythrosine (FD&C Red No. 3), Brilliant Blue FCF (FD&C Blue No. 1), Indigotine (FD&C Blue No. 2), Tartrozine (FD&C Yellow No. 5), Sunset Yellow FCF (FD&C Yellow No. 6) and Fast Green FCF (FD&C Green No. 3). See also *The Theory and Practice of Industrial Pharmacy*, Second Edition, 1970, 1976, published by Lea & Febinger, pp. 331–332, for additional dyes and colorants that are acceptable.

Alternatively, should the layer or layers be constructed of microencapsulated material, the microcapsules may contain or be coated with dyes (as explained in *The Theory and Practice of Industrial Pharmacy*, supra, at pp. 420–427) and then mixed in a cement or binder such that the dyes in or on the microcapsules will be dispersed by pressure, shear stress, and/or abrasion.

As another alternative, the upper layer may be made from a dyed block of microencapsulated material adhered to a lower layer made from polymer such as polyethylene oxide, or vice versa.

Figure 7:
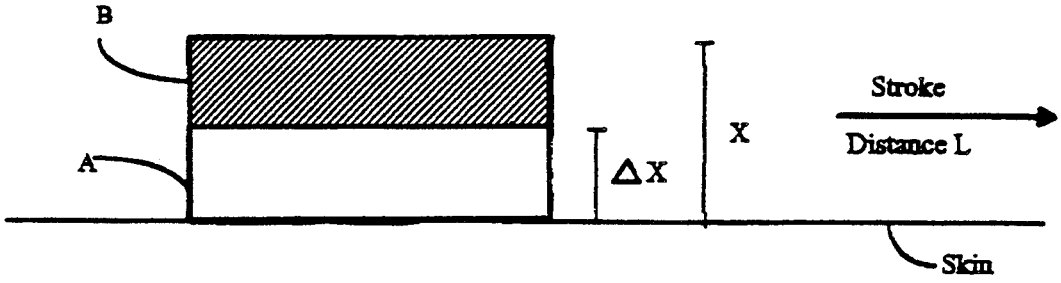
FIG. 7 comprises a diagram illustrating the formula for determining the coefficient of wear for a given set of shaving parameters.

The choice of the material or materials to be employed for the indicating strip depends upon several factors, including the determination of how long a given blade will be or should be used by the shaver, and the approximate desired thickness of the indicator strip in the final product. FIG. 7 comprises a graphical illustration of the problem, in which A represents the upper layer of the indicator means—i.e., the layer or zone that contacts the skin. B represents the lower layer or zone of the indicator means—i.e. the layer closest to the head or cartridge of the razor. X is the total thickness of the indicator means prior to any shaving. L is the distance that the blade is stroked along the skin in a given shaving session. $\Delta X$ is the change in the thickness X resulting from stroking the razor blade over the skin for a distance L. Initially, of course, that change in thickness X occurs at the side of layer A that contacts the skin.

Assuming that the force of the stroke is constant for a given shaving session, it may be posited that $\Delta X$ is directly and linearly a function of the distance of the stroke L:

$$\Delta X = \mu L$$

where $\mu$ can be denominated as the wear coefficient of the particular layer A of material. As a practical matter, a person with a relatively tougher hair or beard will need to stroke the razor more times during a shave, and thus more total distance L. If $\mu$ is a constant for the given layer material, then $\Delta X$ will be larger, since more wear will occur to the indicator strip as a result of the tougher hair or beard. Of course, those with softer hair or beards will require fewer strokes, and therefore L will be smaller, and so will $\Delta X$.

I have found that, on the average, a man strokes the razor on his face a distance of about 100 inches to 300 inches during the course of a shave. Taking the average of 200 inches for the value of L, and assuming, for present purposes, that we would like the lower layer to be completely exposed after four shaves—i.e., that the razor should be discarded after four shaves—we may calculate the value of $\mu$ for a given thickness of material. For example if layer A is 1/32 inch thick, and L=4 shaves times 200 inches per shave=800 inches, then $\mu=3.906\times10^{-5}$. Thus if one desires to make a two-layer indicator means with the lower layer being 1/32 inch thick, and that will signal that the blade should be discarded after four shaves (on average), then one should choose a material having a wear coefficient $\mu$ of $3.906\times10^{-5}$. The wear coefficients of different materials may be readily determined through experimentation, and thus a suitable material may be chosen for a given application.

An advantage of the subject invention is that the amount of wear undergone by strip itself is related to the "toughness" of the skin and hair being shaved—i.e., as stated above, "tough" hair will cause the indicator strip to wear away more rapidly than "soft" hair. At the same time, the blade itself will be subjected to more wear from the "tough" hair than the "soft" hair. Thus the amount of wear on the strip correlates well with the amount of wear on the blade.

It will be readily apparent to those skilled in the art that the present invention in its broader aspects is not limited to the specific embodiments herein shown and described. For example, instead of the visual indication of wear being provided by contrasting colors between the two layers of the strip, or between the strip and the frame or head, the visual indication could be a visually recognizable change in the texture of the indicator means, or a change in the size or geometry of the indicator means as portions are worn away.

Accordingly, variations may be made from the embodiments described herein which are within the scope of the accompanying claims, without departing from the principles of the invention and without sacrificing its chief advantages.

I claim:

1. In a disposable razor or razor cartridge comprising at least one blade mounted in a head or frame, said blade having a shaving edge, the improvement comprising wear indicating means for indicating the amount of wear on the shaving edge, said wear indicating means being located on the head or frame in close proximity to the shaving edge of said blade, and said wear indicating means comprising a strip of material extending generally parallel to the shaving edge, said strip of material gradually wearing away as the disposable razor or razor cartridge is used in shaving, the amount of material wearing away being correlated with the amount of wear on the shaving edge to provide a visual indication of the relative wear on the blade.

2. The razor or cartridge of claim 1, wherein said frame or head is of a first color and said strip of material is of a second color contrasting with said first color.

3. The razor or cartridge of claim 1, wherein said wear indicating means comprises a first strip of material affixed to the frame or head, and a second strip of material affixed on said first strip, the second strip being gradually worn away during shaving to reveal at least part of the first strip.

4. The razor or cartridge of claim 3, wherein said first strip is of a first color, and the second strip is of a second color contrasting with the first color.

5. The razor or cartridge of claim 3, wherein said first strip bears letters or other indicia, which become visible upon the wearing away of the second strip.

6. The razor or cartridge of claim 1, wherein said strip of material includes a first zone adjacent the frame or head, and a second zone covering said first zone, the first zone and the second zone being contrastingly colored so that the color of the first zone becomes visible as the second zone is gradually worn away during shaving.

* * * * *